United States Patent [19]

Lemke

[11] Patent Number: 4,559,883

[45] Date of Patent: Dec. 24, 1985

[54] SEWING MACHINE FOR FORMING A PLURALITY OF SEAMS

[75] Inventor: Cornelis P. Lemke, Apeldoorn, Netherlands

[73] Assignee: Rockwell-Rimoldi S.p.A., Italy

[21] Appl. No.: 623,699

[22] Filed: Jun. 22, 1984

Related U.S. Application Data

[63] Continuation-in-part of Ser. No. 398,496, Jul. 15, 1982, abandoned.

[30] Foreign Application Priority Data

Jul. 22, 1981 [NL] Netherlands ..... 8103466

[51] Int. Cl.[4] ..... D05B 25/00; D05B 35/02

[52] U.S. Cl. ..... 112/136; 112/155; 112/166; 112/DIG. 2

[58] Field of Search ..... 112/136, 150, 151, 155, 112/165, 166, DIG. 2

[56] References Cited

U.S. PATENT DOCUMENTS

| | | | |
|---|---|---|---|
| 874,728 | 12/1907 | Bishop | 112/136 X |
| 1,603,246 | 10/1926 | Rocke | 112/136 X |
| 2,131,250 | 9/1936 | De Voe | 112/136 |
| 3,252,437 | 5/1966 | Pickett | 112/136 |
| 3,395,660 | 8/1968 | Lewis, Jr. et al. | 112/166 X |
| 3,867,891 | 2/1975 | Grabher | 112/166 |

*Primary Examiner*—Wm. Carter Reynolds

[57] ABSTRACT

A sewing machine for simultaneously forming a plurality of spaced seams disposed in parallel relation. The machine includes a pair of spaced needle bars and needle clamps for supporting stitching needles. Adjacent each needle bar a presserfoot bar is provided for supporting separate presserfoots on their lower ends. Below each presserfoot there is a cooperating feed dog and below each feed dog a separate looper for controlling the lower threads during the formation of chain stitches. To form the stitches simultaneously, all of the machine's stitching instrumentalities, including the stitching needles, presserfeet, feed dogs and loopers, are operatively interconnected so that their movements occur at the same time.

6 Claims, 6 Drawing Figures

SEWING MACHINE FOR FORMING A PLURALITY OF SEAMS

This application is a continuation-in-part of Application Ser. No. 398,496 filed July 15, 1982, now abandoned by the same Applicant and assigned to the same assignee of this invention.

BACKGROUND OF THE INVENTION

1. Field of the Invention

The invention pertains to a known type of sewing machine including a needle bar, with a needle clamp for supporting one or more needles, a presserfoot bar for supporting a presserfoot, a needle plate with a cooperating feed dog and a looper or bobbin for the lower thread as well as mechanical elements for effecting the transmission of power to the moving parts.

2. Description of the Prior Art

Sewing machines are widely used for the manufacture of clothing, curtains etc. which have to be joined together by seaming. With known sewing machines, it is possible to form a single seam or, in the case of double or treble needle machines then double or treble seams, can be formed that extend parallel to one another.

An object of this invention is to provide a sewing machine which is capable of forming more than one seam simultaneously which are independent of one another.

SUMMARY OF THE INVENTION

The apparatus according to the invention includes a second needle bar and needle clamp disposed in spaced and parallel relation to the first needle bar as well as a second presserfoot bar having a second presserfoot attached to the lower end thereof. Additionally, the apparatus includes a second feed dog device that is operatively connected to the first and second looper or bobbin mechanism that is operatively connected to the first looper or bobbin mechanism.

With this arrangement, a space is provided between the needle bars and needle plates and, by means of special guide members, the material forming a workpiece is caused to follow a predetermined pathway. With a sewing machine equipped with the invention, it is possible to form two seams at the same time even though the distance between the seams is not necessarily the same as the distance between the needles of the sewing machine.

Guides defining screenplates are attached to the presserfoot bars and are caused to move up and down with said presserfoot bars whereby the lower edge of the guides cannot be moved beyond the lower surface of the presserfoot. When the presserfoot bar and the screenplates attached thereto are in an elevated position, the workpiece is easily placed beneath the presserfoot whereat it is in readiness to initiate the sewing operation. The lowering of the presserfoot bar causes the workpiece to be held fast between the presserfoot and feed dog and the screenplates that are lowered with the bar serve to protect the associated moving parts of the machine. In sewing machine equipped with the apparatus according to the invention, devices are provided for urging the material upwardly or downwardly as required during the sewing cycle. These devices consist of a plurality of pneumatic valves from which pressurized air or other gas is emitted. The devices serve to displace the excess material being sewn by urging it into the space intermediate the needle bars and needle plates so that the material will not be incorrectly sewn.

To cause the sewing machine to perform its intended function quickly and effectively, it is provided with guide members disposed on the forward portion of the machine which define metal strips that are disposed so that there is a narrow space between the lower side of the guide members and the machine's worksurface that serves to guide the workpiece as it is caused to be advanced to the sewing zone. If such a machine were to be used on a commercial basis, it would be advantageous to utilize additional pneumatic valves above and below the workpiece so that less effort would be required to effect movement of the workpiece.

Other objects and advantages of the invention will become more fully apparent by reference to the appended claims and as the following detailed description proceeds in reference to the Figures of drawings wherein:

DESCRIPTION OF THE PREFERRED EMBODIMENT

Figure 1:
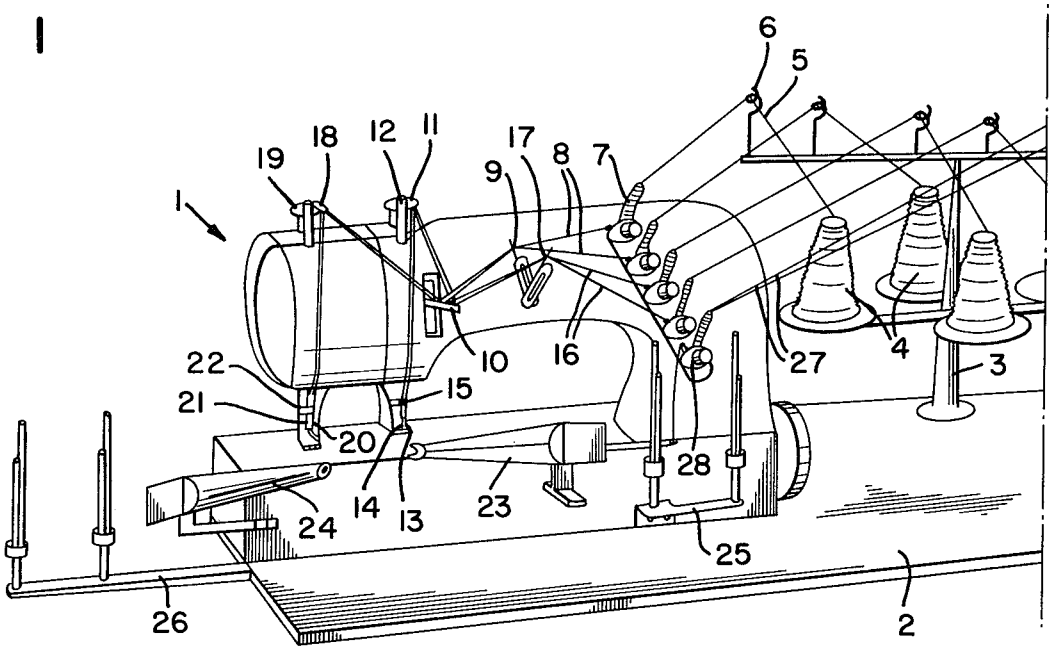
FIG. 1 is a perspective view of a sewing machine to which the apparatus according to the invention has been applied.

In FIG. 1 a sewing machine identified generally by the numeral 1 is shown mounted on a table 2. Adjacent the sewing machine 1, the table 2 also has a bobbin support stand 3 fixed thereon that carries a plurality of thread bobbins 4 from which threads 5 are withdrawn and caused to pass through guides 6 and tension regulators 7. A pair of threads 8 extend from a pair of adjacent tension regulators 7 through a thread guide 9 and then separately through a first thread guide 10 and then to a second thread guide 11 which is fixed adjacent to the upper end of a needle bar 12. From this location the threads extend separately to needles 13, 14, respectively, which are both carried in a needle clamp 15 that is fixed on the lower end of the needle bar 12. A second pair of threads depicted by numeral 16 also extend from another pair of tension regulators 7 through a thread guide 17 and then through the first thread guide 10 and then to a third thread guide 18 that is fixed adjacent to the upper end of a second needle bar 19. The threads then extend separately to needles 20 and 21 which are carried in a second needle clamp 22 that is fixed to the lower end of a second needle bar 19. This machine is specially adapted for the attachment of collaretstrip lace or elastic lace onto the legs of slips.

Figure 2:
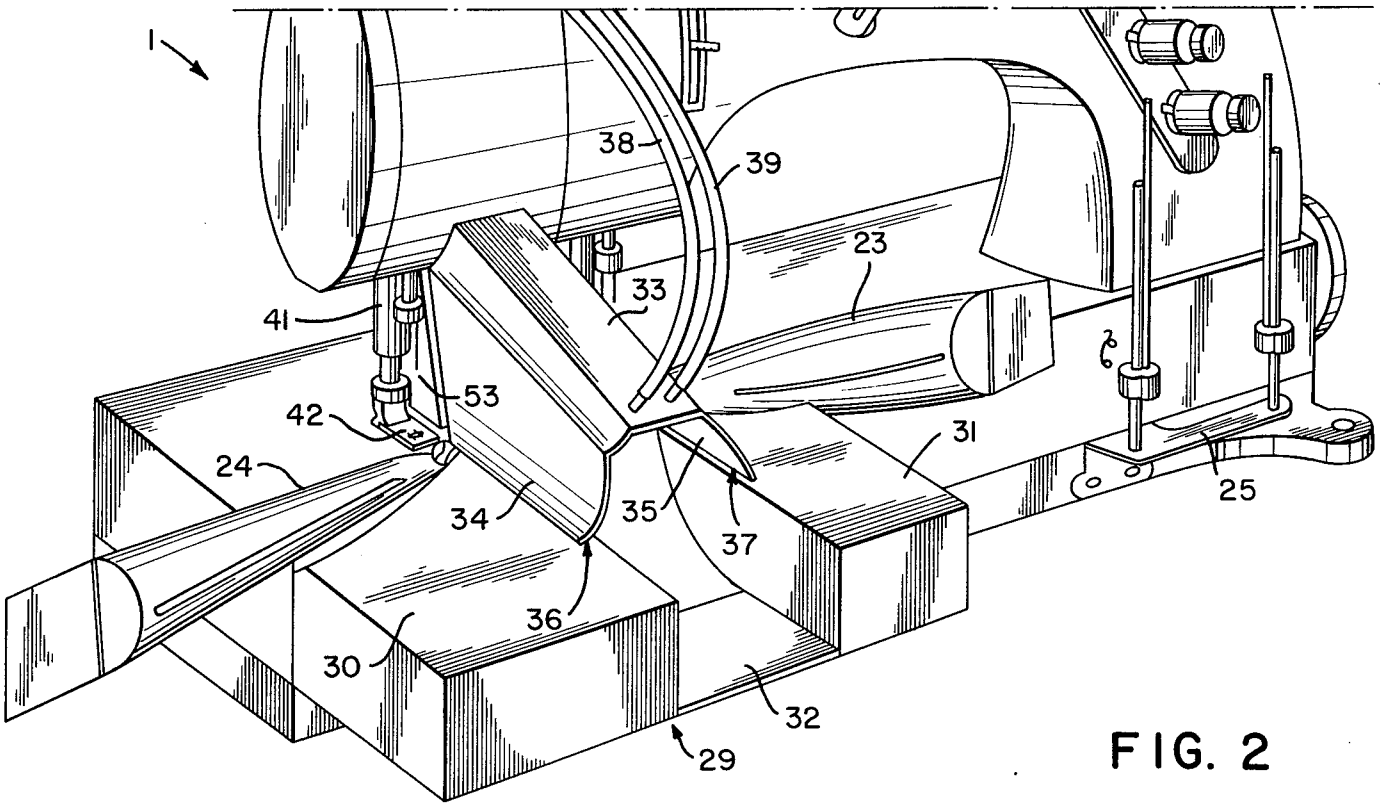
FIG. 2 is a perspective view, on an enlarged scale, of the machine in FIG. 1 showing further detail of the invention.

As shown in FIGS. 1 and 2, the sewing machine is provided with first and second guides 23 and 24, respectively, together with a first guide assembly 25 and a second guide assembly 26 for collaretstrip. In FIG. 1 the two lower threads for forming chain stitches are depicted by numeral 27 and from their source extend through a tension regulator 28 and then to the lower part of the machine in a manner well known to those conversant in the art. As shown in FIG. 2, the forward portion of the machine is provided with a working surface generally indicated by numeral 29 which includes two planar surfaces 30 and 31 with a channel 32 disposed therebetween. A workpiece guide in the form of a hood member 33 is assembled above and in close proximity with the planar surfaces 30 and 31 of the working surface 29. This hood member 33 is provided with spaced and downwardly directed side plates 34 and 35 which have lower edges that cooperate with the planar surfaces 30 and 31, respectively, so as to define relatively narrow guideways or slots therebetween that are depicted generally by numerals 36 and 37. These slots 36 and 37 are located on each side of the channel 32 and serve to guide the workpiece as it is being advanced to the sewing zones. The excess portion of the workpiece between the seams is caused to be received into the channel 32 and to be advanced therein during the seaming operation. Two pneumatic supply lines 38 and 39 are operatively connected to the hood member 33 (FIG. 2) and serve to direct jets of air onto the workpiece so that the excess portion thereof will be directed into the channel 32 between the two seams being formed.

Figure 3:
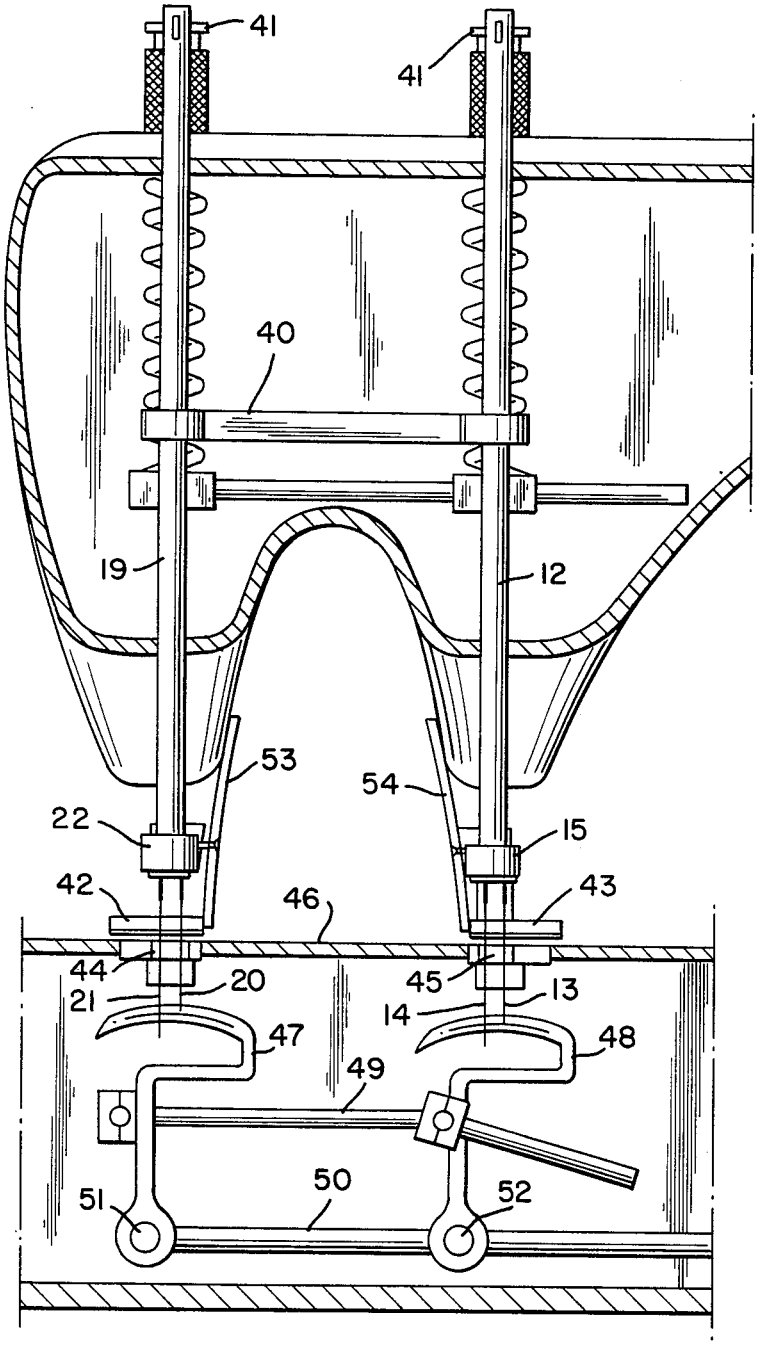
FIG. 3 is a sectional view of a portion of the sewing machine showing the means for forming separate and independent chains of stitches.

In FIG. 3 the sewing machine's needle bars 12 and 19 are shown interconnected by a link member 40 that serves to effect the same movement to each needle bar simultaneously. Rearwardly of each needle bar 12 and 19 the machine is provided with a presserfoot bar 41 and with the lower ends of each having a presserfoot assembled thereon which are identified by numerals 42 and 43, respectively.

Needle bars 12 and 19 are provided with needle clamps 15 and 22 and respectively the latter are adapted to support needles 13, 14 and 20, 21 as shown in FIG. 3. In this Figure of the drawings, the first and second feed dogs are identified by numerals 44 and 45 and are operatively connected to one another by means not shown so that they will advance the workpiece beneath the needles simultaneously. Because the sewing machine to which the invention is applicable is adapted for forming chain stitches, a pair of loopers 47 and 48 are located beneath the needle plate 46 rather than cooperating bobbins. These loopers 47 and 48 are operatively interconnected by bar members 49, 50 and serve to control the double lower looper assembly 51, 52. In FIG. 3 the screenplates are depicted by numerals 53 and 54 and are attached to both presserfoot bars 41.

Figure 4:
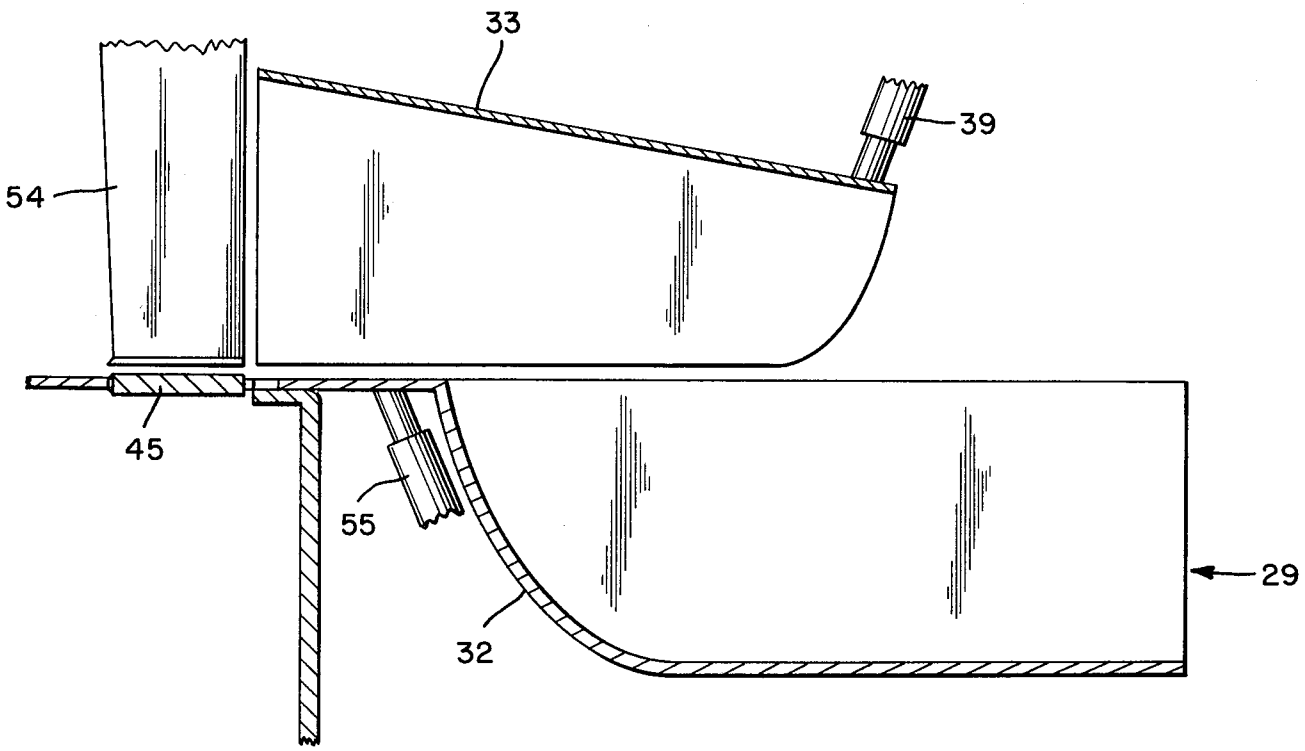
FIG. 4 is a sectional view in side elevation of the workpiece guide members shown in FIG. 2.

As shown in FIG. 4, the hood member 33 is located slightly above the planar surfaces of the working surface 29 which includes the channel 32. The air supply line 39 serves to direct compressed air into the upper portion of the hood member 33 and a second pneumatic supply line 55 spaced from the first cooperates with the latter so as to urge the workpiece between the needles and in a direction rearward of the latter. FIG. 4 also shows one of the screenplates 54 which serves to protect the workpiece being sewn from the moving needles and needle bar. The feed dog 45 is shown schematically along with a small portion of the sewing machine's working surface. The sewing machine to which the invention is applicable is specially adapted for industrial production of the sewing of collaretstrips, elastic lace or similar material to the legs of slips.

Figure 5:
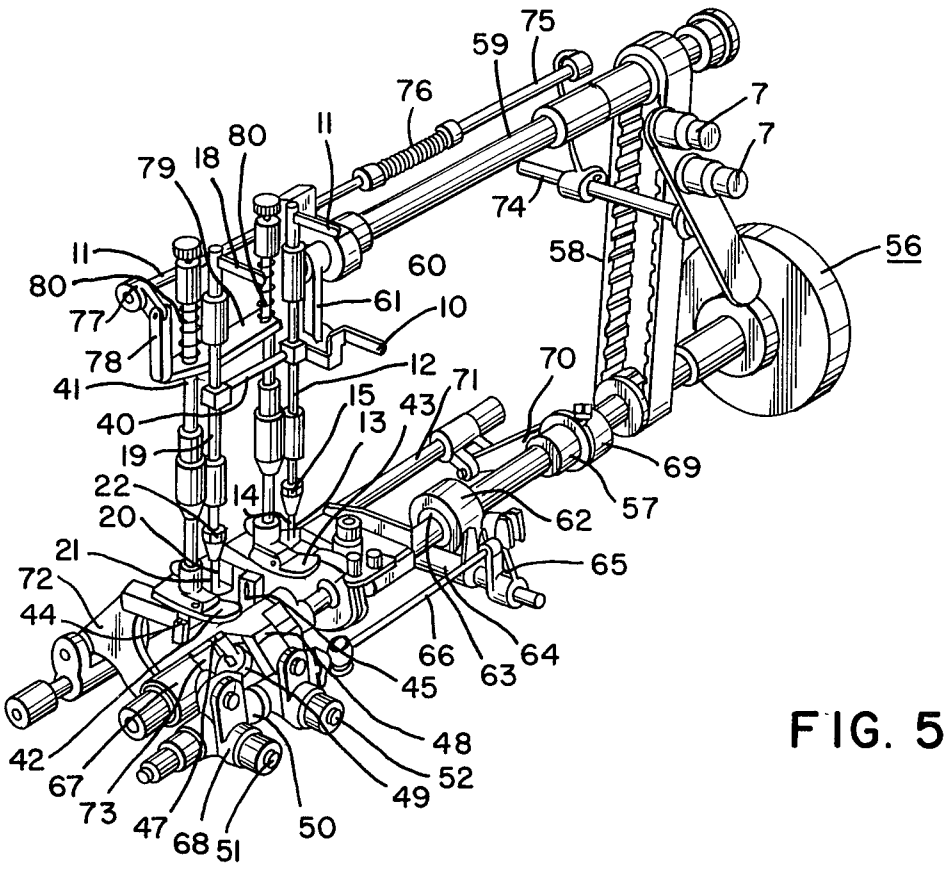
FIG. 5 is a perspective view showing the interior operating parts of the sewing machine and how the twin sewing mechanisms are operated.
Figure 6:
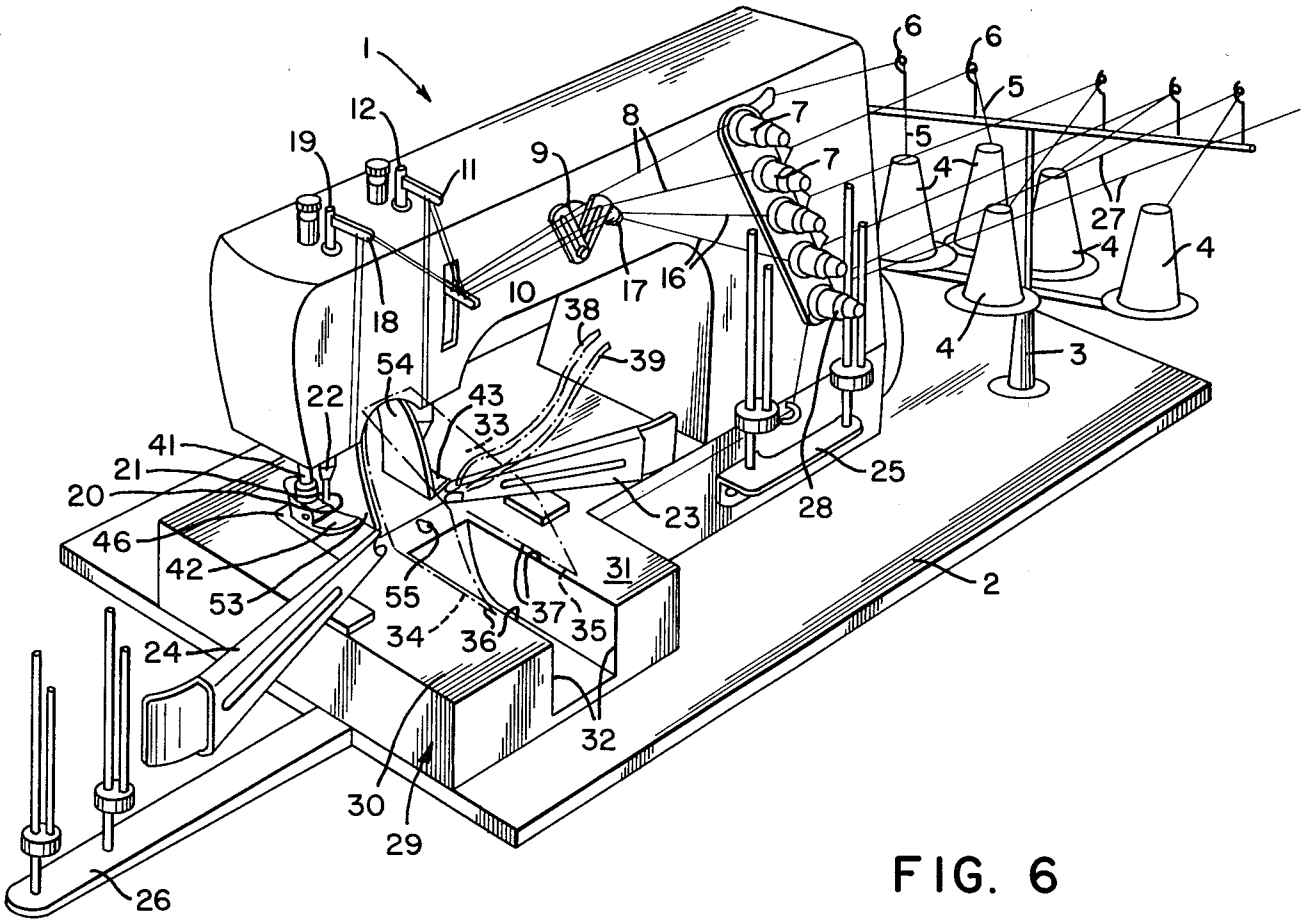
FIG. 6 is more detailed view of the sewing machine of FIG. 1.

The actuation of the various parts of the machine shown in the actual FIG. 3, is described, in connection with FIG. 5, as follows:

Hand wheel 56 is fixed to the main driving shaft 57, that by the ribbed belt 58 transmits the rotation to the top shaft 59, that by the connection crank 60 and link 61, transmits the up and down movements to the needle bar 12.

The latter is interconnected with needle bar 19 through the link member 40, for the simultaneous movement of both the needle bars 12 and 19.

The pitman 62 connected with the eccentric 63 fixed to the shaft 57 transmits, through crank 64 and rocker arm 65, an oscillating movement to the rod 66 connected to the looper 48.

The latter is interconnected with the looper 47 by the bar 49. The eccentric 67 on the main shaft 57, through the carrier 68, transmits the oscillating movement to the loopers 47 and 48, around the shaft 50.

The eccentric 69 is fixed to the main shaft 57 transmits, through the pitman 70, the oscillating movement to the feed driving shaft 71 connected to the feed bar 72, connecting the feed dog 44.

The latter is rigidly fixed to the second feed dog 45 for simultaneous movement.

The eccentric 73 fixed on the shaft 57 is connected to both the feed dogs 44 and 45 for their lift, that is combined with the feed advance to obtain the known eliptical path.

The presser bars actuating shaft 74 is connected to the lifting shaft 75, with the return spring 76.

This shaft 75, through lifter arm 77 and link rod 78, is connected to the member 79 for the lifting of both the presser bars 41, whose pressure is exerted by the springs 80.

Prior to the instant invention, it was necessary that this type of sewing be accomplished in two stages or, in other words, just one leg would be sewn and then the other. With the machine of the invention, it is possible for an operator to sew both legs simultaneously. This accomplishment is considered a definite advance in the art for it not only has the advantage of the work being done by one person in a shorter period of time, but has the advantage that both legs will be of equal size because they are sewn under equal tension. With the known method of sewing on strips, a difference is likely to occur because the tension varies when a workpiece is fed to the sewing zone a second time for the results are never the same twice.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. In a sewing machine of the type having a supporting frame and a planar work surface for advancing a workpiece to the sewing zone, a device for simultaneously forming a plurality of spaced and parallel seams of chain stitches comprising:

(a) a pair of spaced needle bars mounted in the supporting frame including:

(i) a needle clamp for supporting at least one needle fixed to the lower end of each needle bar;

(ii) means interconnecting said needle bars for effecting simultaneous actuation thereof;

(b) a presserfoot bar mounted for reciprocating movement adjacent each said needle bar including:

(i) a presserfoot mounted on the lower end thereof in operative association with the needles carried by said needle clamps;

(ii) means interconnecting said presserfoot bars for effecting simultaneous actuation of the presserfeet carried thereby;

(c) a feed dog mounted below and in operative association with each presserfoot; and (d) a looper pivotally mounted below each feed dog including:

(i) means interconnecting one looper with the other for effecting simultaneous movement thereof to and from operative association with the needles carried by said needle clamps.

2. The sewing machine as set forth in claim 1, wherein the work surface extending between said needle bars and presserfeet defines a channel (32) for receiving and guiding the excess workpiece material located intermediate the latter's seam receiving areas.

3. The sewing machine as set forth in claim 2, which includes a workpiece guide defining a hood member (33) mounted above and in close proximity with said channel (32).

4. The sewing machine as set forth in claim 3, wherein said hood member (33) includes:

(a) a pair of spaced and downwardly directed side plates (34, 35) defining guideways (36, 37) for guiding a workpiece to the sewing zones.

5. The sewing machine as set forth in claim 4 which includes pneumatic supply lines (38, 39, 55) operatively associated with said channel (32) for directing compressed air in directions for urging the portion of the workpiece intermediate the sewing zones into said channel and in a direction rearwardly of said sewing zones.

6. The sewing machine as set forth in claim 4, which includes a screenplate (53, 54) attached to and for vertical movement with each presserfoot bar for guiding a workpiece leaving the guideways (36, 37) respectively.

* * * * *